US006935765B2

(12) United States Patent
Hsu

(10) Patent No.: US 6,935,765 B2
(45) Date of Patent: Aug. 30, 2005

(54) SUSPENSION LAMP HAVING QUICK CONNECTION FUNCTION

(75) Inventor: Kevin Hsu, Taichung (TW)

(73) Assignee: Dong Guan Bright Yinhuey Lighting Co., Ltd. China, Guang Dong (CN)

( * ) Notice: Subject to any disclaimer, the term of this patent is extended or adjusted under 35 U.S.C. 154(b) by 72 days.

(21) Appl. No.: 10/694,093

(22) Filed: Oct. 27, 2003

(65) Prior Publication Data

US 2005/0088846 A1 Apr. 28, 2005

(51) Int. Cl.[7] ..... F21S 8/06

(52) U.S. Cl. ..... 362/405; 362/147; 362/457; 439/537

(58) Field of Search ..... 362/405, 145, 362/457, 150, 404; 439/537, 188, 531, 576, 76.1; 307/157, 147

(56) References Cited

U.S. PATENT DOCUMENTS 6,238,239 B1 * 5/2001 Wu ..... 439/537
6,369,325 B1 * 4/2002 Wu ..... 174/52.1
6,514,095 B1 * 2/2003 Smith et al. ..... 439/306
6,600,102 B1 * 7/2003 Wu ..... 174/50
6,780,050 B1 * 8/2004 Wu ..... 439/544
6,851,967 B2 * 2/2005 Miyoshi et al. ..... 439/441
2003/0148659 A1 * 8/2003 Walker et al. ..... 439/537

* cited by examiner

*Primary Examiner*—Stephen Husar
*Assistant Examiner*—Jason Han
(74) *Attorney, Agent, or Firm*—Alan D. Kamrath; Nikolai & Mersereau, P.A.

(57) ABSTRACT

A suspension lamp includes a switch box, and a wire connection base. The wire connection base includes a main body, a plurality of elastic locking members, a first conductive plate, and a second conductive plate. Thus, the first and second connecting terminals of the power supply wire are inserted into the first and second insertion slots of the main body respectively, and the first and second connecting terminals of each of the electric wires are inserted into the first and second insertion slots of the main body respectively so as to form an electrical connection state, so that the electric circuit of the suspension lamp is connected easily and conveniently, thereby facilitating the operator mounting the suspension lamp.

15 Claims, 6 Drawing Sheets

SUSPENSION LAMP HAVING QUICK CONNECTION FUNCTION

BACKGROUND OF THE INVENTION

1. Field of the Invention

The present invention relates to a suspension lamp, and more particularly to a suspension lamp having a quick connection function.

2. Description of the Related Art

A conventional suspension lamp 1 in accordance with the prior art shown in FIG. 1 comprises a switch box 11 having a peripheral wall formed with a plurality of locking grooves 111, a plurality of bent support tubes 12 each mounted on the switch box 11 and each having an end formed with a connector 121 locked in a respective one of the locking grooves 111 of the switch box 11, an upper cover 14 mounted on an opened top of the switch box 11 and having a center formed with a through hole 141, a hollow threaded rod 13 mounted in the switch box 11 and having a first end extended through the through hole 141 of the upper cover 14 and a second end formed with a threaded section 131 formed with an opening 132, a nut 142 screwed on the first end of the threaded rod 13 and rested on the upper cover 14, a screw 15 extended through a closed bottom of the switch box 11 and screwed into the threaded section 131 of the threaded rod 13, and a nut 16 screwed on the screw 15 and rested on the bottom of the switch box 11. The conventional suspension lamp further comprises a power supply wire 17 extended through the threaded rod 13 and the opening 132, and a plurality of electric wires 18 each extended through a respective one of the support tubes 12 and each connected to the power supply wire 17.

However, the operator needs to separate the positive and negative poles of each of the electric wires 18 respectively, so that the positive and negative poles of each of the electric wires 18 are connected to the positive and negative poles of the power supply wire 17 respectively and are coated by a protective tape 19 to prevent occurrence of electrical leakage. Thus, the operator is located a higher position to separate the positive and negative poles of each of the electric wires 18 respectively, to connect the positive and negative poles of each of the electric wires 18 with the positive and negative poles of the power supply wire 17 respectively, and to coat the connected electric wires 18 by the protective tapes 19, thereby causing inconvenience to the operator in assembly of the conventional suspension lamp.

SUMMARY OF THE INVENTION

The primary objective of the present invention is to provide a suspension lamp having a quick connection function.

Another objective of the present invention is to provide a suspension lamp having a better safety when in use.

A further objective of the present invention is to provide a suspension lamp, wherein the first connecting terminal and the second connecting terminal of the power supply wire are inserted into the first insertion slot and the second insertion slot of the main body respectively, and the first connecting terminal and the second connecting terminal of each of the electric wires are inserted into the first insertion slot and the second insertion slot of the main body respectively so as to form an electrical connection state, so that the electric circuit of the suspension lamp is connected easily and conveniently, thereby facilitating the operator mounting the electric circuit of the suspension lamp.

A further objective of the present invention is to provide a suspension lamp, wherein the first insertion slots and the second insertion slots of the main body are arranged in an opposite staggered manner, so that the operator can identify the positive and negative poles of the power supply wire and each of the electric wires, thereby facilitating the operator mounting the suspension lamp.

In accordance with the present invention, there is provided a suspension lamp, comprising:

a switch box; and a wire connection base mounted in the switch box and including a main body, a plurality of elastic locking members, a first conductive plate, and a second conductive plate, wherein:

the main body has a first side formed with a plurality of first locking slots and a plurality of second locking slots and a second side formed with a plurality of first insertion slots each communicating with a respective one of the first locking slots and a plurality of second insertion slots each communicating with a respective one of the second locking slots;

the main body is formed with a first groove located between a peripheral wall of the main body and the first locking slots and second locking slots, and a second groove located between the passage hole of the main body and the first locking slots and second locking slots;

each of the elastic locking members is mounted in a respective one of the first locking slots and second locking slots of the main body and includes a reed, a protruded limit plate extended outward from the reed and having a bent end formed with a clamping leg;

the first conductive plate is mounted in the first groove of the main body and has an inner wall rested on the reed of each of the elastic locking members; and the second conductive plate is mounted in the second groove of the main body and has an outer wall rested on the limit plate of each of the elastic locking members.

Further benefits and advantages of the present invention will become apparent after a careful reading of the detailed description with appropriate reference to the accompanying drawings.

DETAILED DESCRIPTION OF THE INVENTION

Figure 1:
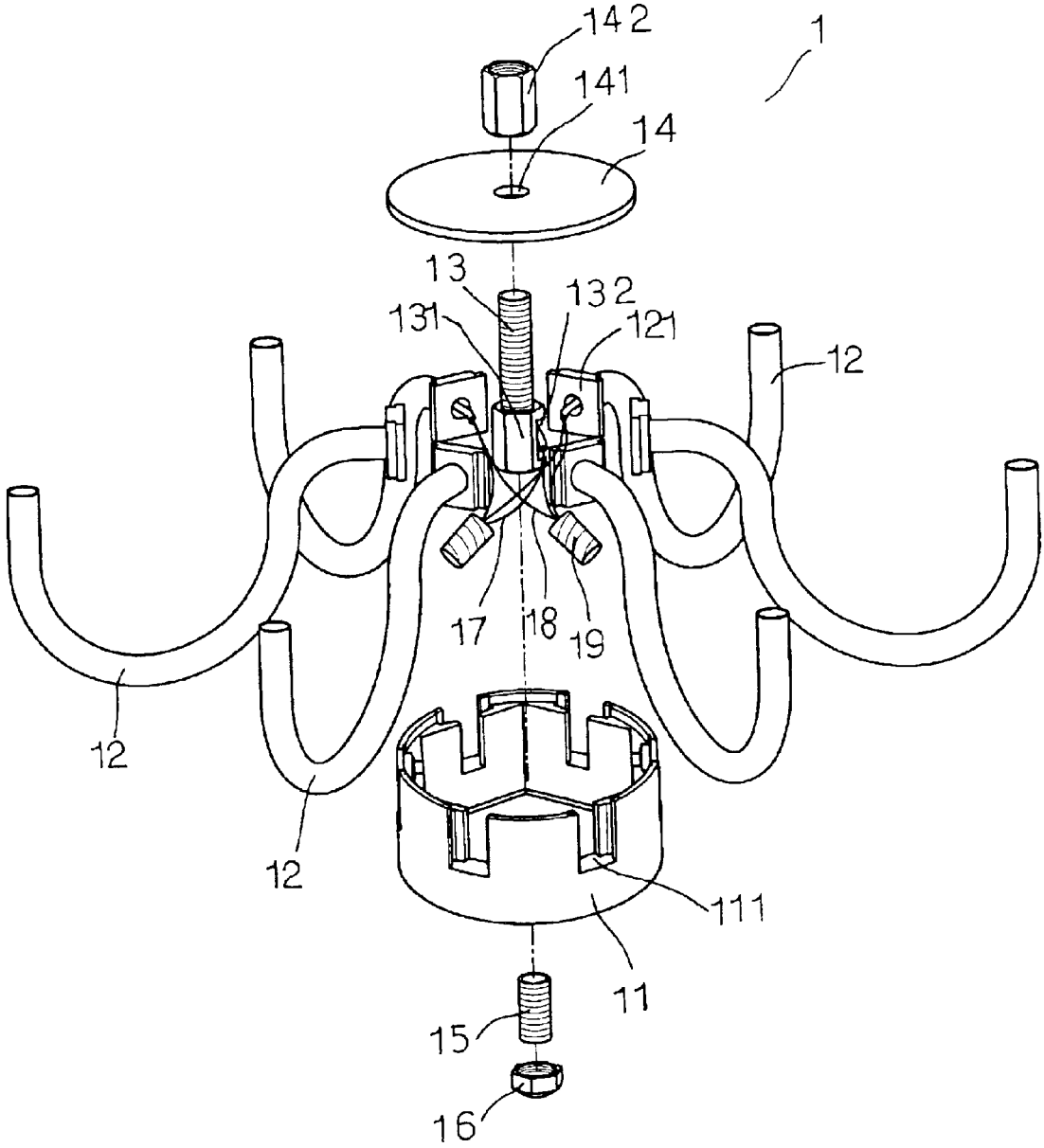
FIG.1 PRIOR ART
FIG. 1 is an exploded perspective view of a conventional suspension lamp in accordance with the prior art.

Referring to the drawings and initially to FIGS. 2–5, a suspension lamp in accordance with the preferred embodiment of the present invention comprises a switch box 2 having a peripheral wall formed with a plurality of locking grooves 21, a plurality of bent support tubes 3 each mounted on the switch box 2 and each having an end formed with a connector 31 locked in a respective one of the locking grooves 21 of the switch box 2, an upper cover 23 mounted on an opened top of the switch box 2 and having a center formed with a through hole 231, a hollow threaded rod 22 mounted in the switch box 2 and having a first end extended through the through hole 231 of the upper cover 23 and a second end formed with a threaded section 221 formed with an opening 222, a nut 232 screwed on the first end of the threaded rod 22 and rested on the upper cover 23, a screw 24 extended through a closed bottom of the switch box 2 and screwed into the threaded section 221 of the threaded rod 22, and a nut 25 screwed on the screw 24 and rested on the bottom of the switch box 2.

The suspension lamp further comprises a wire connection base 4 mounted in the switch box 2 and including a main body 41, a plurality of elastic locking members 42, a first conductive plate 43, a second conductive plate 44, and a cap 45.

The main body 41 has a center formed with a passage hole 411 for passage of the threaded rod 22. The main body 41 has a periphery formed with a plurality of through holes 416.

Figure 6:
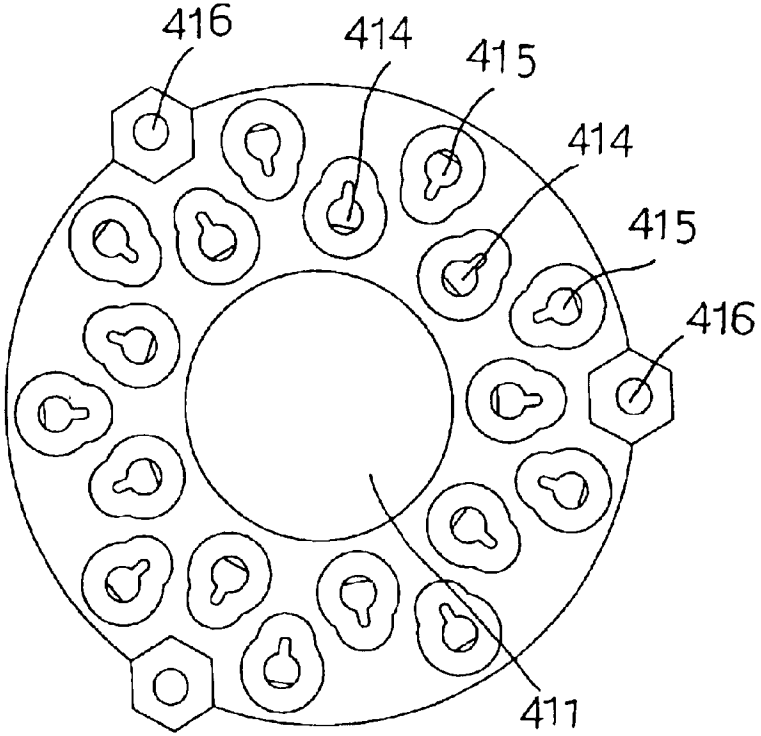
FIG. 6 is a plan view of a main body of the wire connection base of the suspension lamp as shown in FIG. 4.
Figure 7:
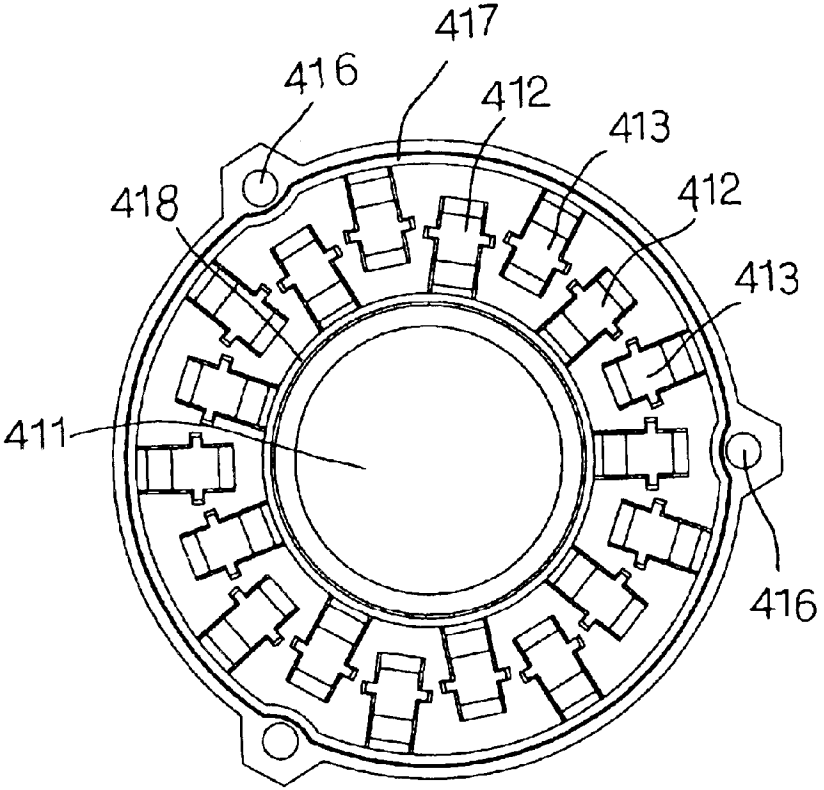
FIG. 7 is a plan view of the main body of the wire connection base of the suspension lamp as shown in FIG. 4.

As shown in FIGS. 6 and 7, the main body 41 has a first side formed with a plurality of first locking slots 412 and a plurality of second locking slots 413 and a second side formed with a plurality of first insertion slots 414 each communicating with a respective one of the first locking slots 412 and a plurality of second insertion slots 415 each communicating with a respective one of the second locking slots 413. Preferably, the first locking slots 412 and the second locking slots 413 of the main body 41 are arranged in an opposite staggered manner, and the first insertion slots 414 and the second insertion slots 415 of the main body 41 are arranged in an opposite staggered manner.

In addition, the main body 41 is formed with a first groove 417 located between a peripheral wall of the main body 41 and the first locking slots and second locking slots 412 and 413, and a second groove 418 located between the passage hole 411 of the main body 41 and the first locking slots and second locking slots 412 and 413.

Each of the elastic locking members 42 is mounted in a respective one of the first locking slots and second locking slots 412 and 413 of the main body 41 and includes a reed 421, a protruded limit plate 422 extended outward from the reed 421 and having a bent end formed with a clamping leg 423, thereby defining an elastic receiving space 424 between the reed 421, the limit plate 422 and the clamping leg 423. Preferably, the bent limit plate 422 is integrally formed on the reed 421.

The first conductive plate 43 is substantially ring-shaped and is mounted in the first groove 417 of the main body 41. The first conductive plate 43 has an inner wall rested on the reed 421 of each of the elastic locking members 42 and an outer wall formed with a plurality of arc-shaped recesses 431 each located beside a respective one of the through holes 416 of the main body 41.

The second conductive plate 44 is substantially ring-shaped and is mounted in the second groove 418 of the main body 41. The second conductive plate 44 has an outer wall rested on the limit plate 422 of each of the elastic locking members 42.

The cap 45 is mounted on the main body 41 and has a center formed with a passage hole 451 for passage of the threaded rod 22. The cap 45 has a periphery formed with a plurality of through holes 452, and the wire connection base 4 further includes a plurality of screws 46 each extended through a respective one of the through holes 452 of the cap 45 and a respective one of the through holes 416 of the main body 41, and a plurality of nuts 47 (see FIG. 5) each screwed on a respective one of the screws 46.

The suspension lamp further comprises a power supply wire 6 having a positive pole formed with a first connecting terminal 61 and a negative pole formed with a second connecting terminal 62, and a plurality of electric wires 5 each having a positive pole formed with a first connecting terminal 51 and a negative pole formed with a second connecting terminal 52.

In assembly, some of the elastic locking members 42 are inserted into the first locking slots 412, and some of the elastic locking members 42 are inserted into the second locking slots 413 of the main body 41 in the opposite direction. Then, the first conductive plate 43 is mounted in the first groove 417 of the main body 41. Then, the second conductive plate 44 is mounted in the second groove 418 of the main body 41. Then, the cap 45 is mounted on the main body 41 by the screws 46 and the nuts 47, thereby assembling the wire connection base 4.

Then, the wire connection base 4 is mounted in the switch box 2, with the first insertion slots 414 and the second insertion slots 415 of the main body 41 being directed upward. Then, the power supply wire 6 is extended through the threaded rod 22 and the opening 222. At this time, the first connecting terminal 61 and the second connecting terminal 62 of the power supply wire 6 are inserted into the first insertion slot 414 and the second insertion slot 415 of the main body 41 respectively, and are locked in the receiving spaces 424 of the elastic locking members 42 respectively to form an electrical connection state.

Then, the connector 31 of each of the support tubes 3 is locked in a respective one of the locking grooves 21 of the switch box 2. Then, each of the electric wires 5 is extended through a respective one of the support tubes 3. At this time, the first connecting terminal 51 and the second connecting terminal 52 of each of the electric wires 5 are inserted into the first insertion slot 414 and the second insertion slot 415 of the main body 41 respectively, and are locked in the receiving spaces 424 of the elastic locking members 42 respectively to form an electrical connection state.

Figure 2:
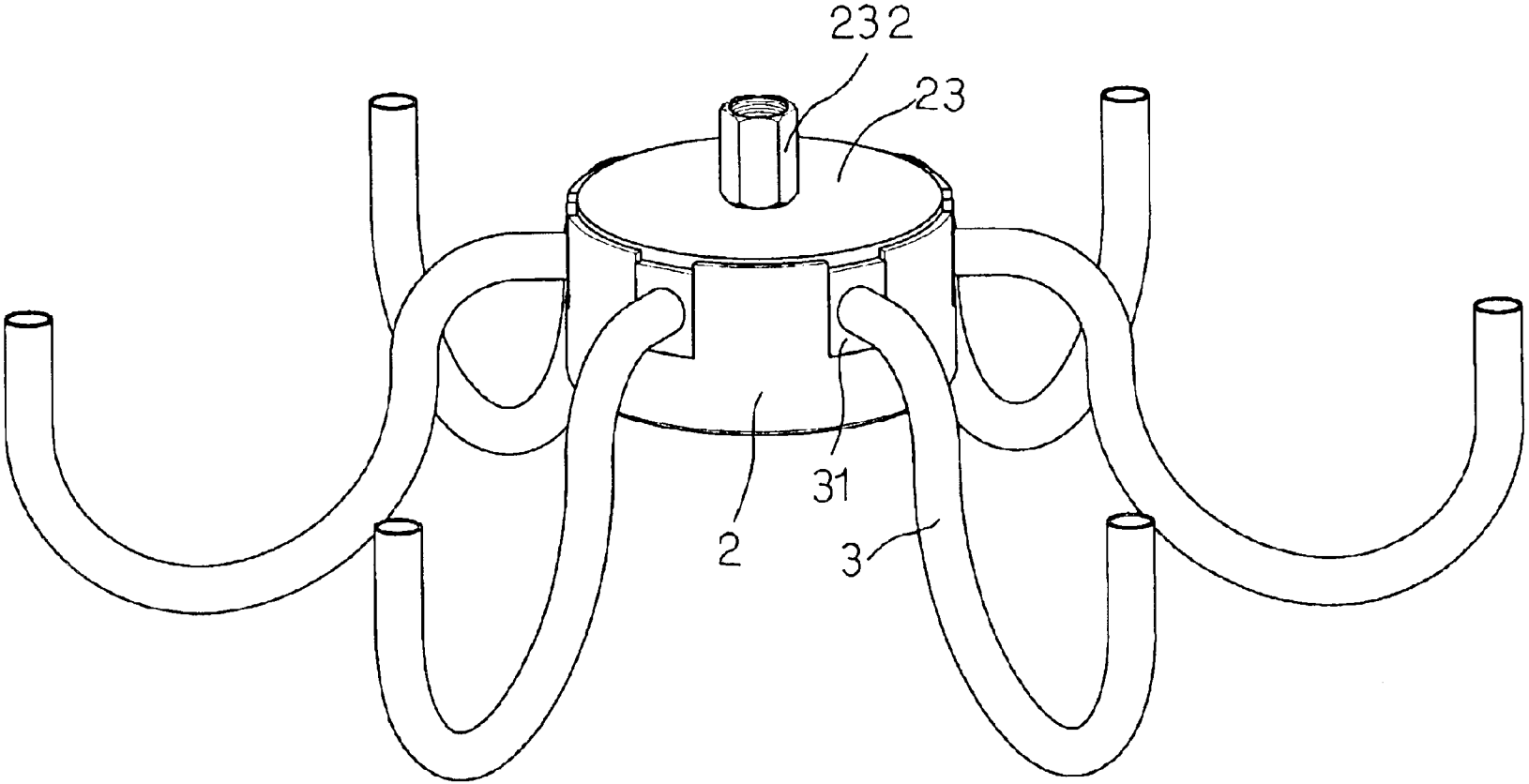
FIG. 2 is a perspective view of a suspension lamp in accordance with the preferred embodiment of the present invention.
Figure 3:
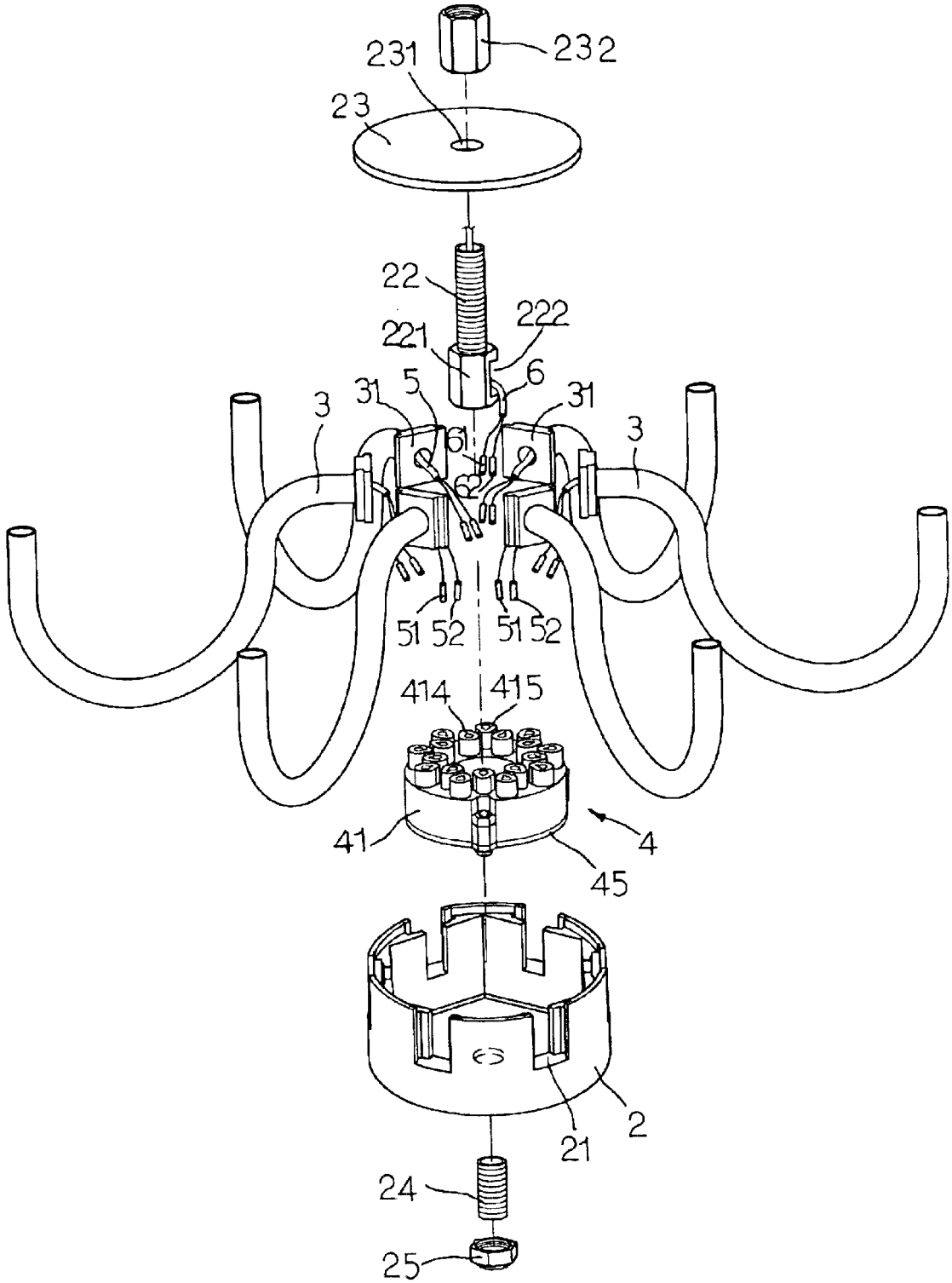
FIG. 3 is an exploded perspective view of the suspension lamp as shown in FIG. 2.
Figure 4:
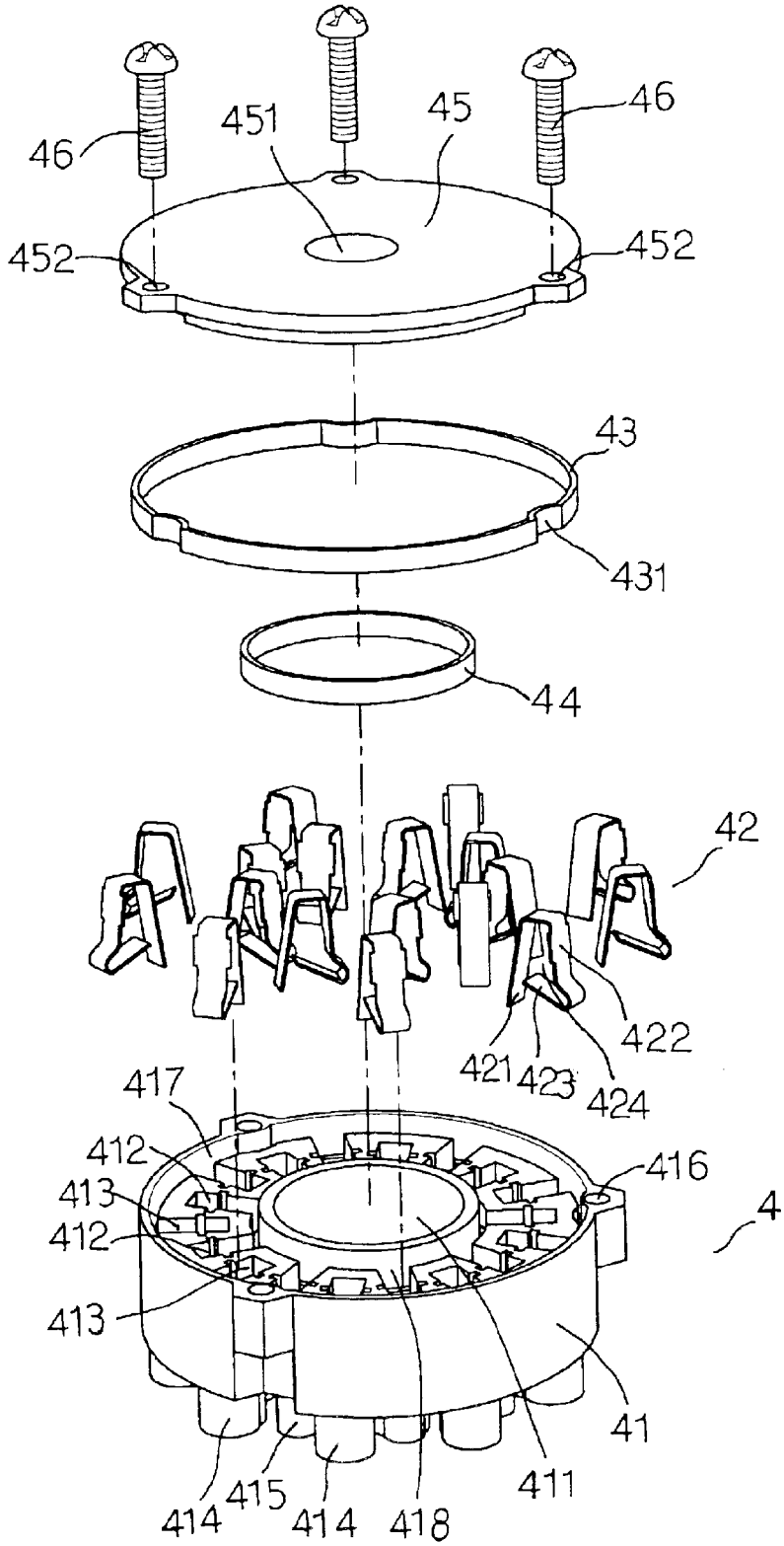
FIG. 4 is an exploded perspective view of a wire connection base of the suspension lamp as shown in FIG. 3.
Figure 5:
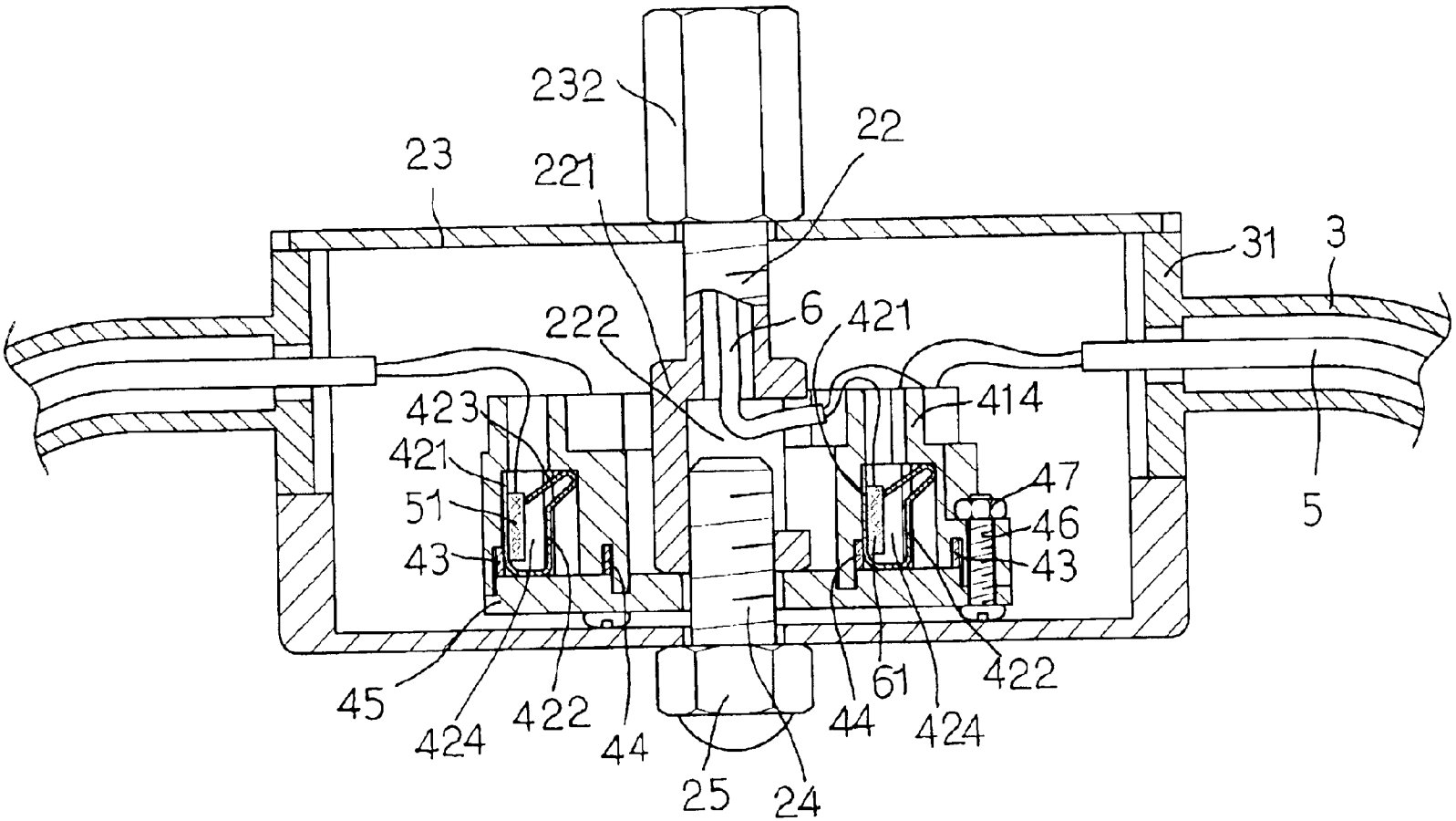
FIG. 5 is a partially cut-away plan cross-sectional view of the suspension lamp as shown in FIG. 2.

Finally, the upper cover 23 is mounted on the opened top of the switch box 2 and is combined with the threaded rod 22 by the nut 232, and the threaded rod 22 is combined with the screw 24 by the nut 25, thereby assembling the suspension lamp as shown in FIG. 2.

Accordingly, the first connecting terminal 61 and the second connecting terminal 62 of the power supply wire 6 are inserted into the first insertion slot 414 and the second insertion slot 415 of the main body 41 respectively, and the first connecting terminal 51 and the second connecting terminal 52 of each of the electric wires 5 are inserted into the first insertion slot 414 and the second insertion slot 415 of the main body 41 respectively so as to form an electrical connection state, so that the electric circuit of the suspension lamp is connected easily and conveniently, thereby facilitating the operator mounting the electric circuit of the suspension lamp. In addition, the first insertion slots 414 and the second insertion slots 415 of the main body 41 are arranged in an opposite staggered manner, so that the operator can identify the positive and negative poles of the power supply wire 6 and each of the electric wires 5, thereby facilitating the operator mounting the suspension lamp.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A suspension lamp, comprising:

a switch box; and a wire connection base mounted in the switch box and including a main body, a plurality of elastic locking members, a first conductive plate, and a second conductive plate, wherein:

the main body has a first side formed with a plurality of first locking slots and a plurality of second locking slots and a second side formed with a plurality of first insertion slots each communicating with a respective one of the first locking slots and a plurality of second insertion slots each communicating with a respective one of the second locking slots;

the main body is formed with a first groove located between a peripheral wall of the main body and the first locking slots and second locking slots, and a second groove located between a passage hole of the main body and the first locking slots and second locking slots;

each of the elastic locking members is mounted in a respective one of the first locking slots and second locking slots of the main body and includes a reed, a protruded limit plate extended outward from the reed and having a bent end formed with a clamping leg;

the first conductive plate is mounted in the first groove of the main body and has an inner wall rested on the reed of each of the elastic locking members; and the second conductive plate is mounted in the second groove of the main body and has an outer wail rested on the limit plate of each of the elastic locking members.

2. The suspension lamp in accordance with claim 1, wherein the first locking slots and the second locking slots of the main body are arranged in an opposite staggered manner.

3. The suspension lamp in accordance with claim 1, wherein the first insertion slots and the second insertion slots of the main body are arranged in an opposite staggered manner.

4. The suspension lamp in accordance with claim 1, wherein each of the elastic locking members has an elastic receiving space defined between the reed, the limit plate and the clamping leg.

5. The suspension lamp in accordance with claim 1, wherein the bent limit plate is integrally formed on the reed.

6. The suspension lamp in accordance with claim 1, wherein the first conductive plate is substantially ring-shaped.

7. The suspension lamp in accordance with claim 1, wherein the first conductive plate has an outer wall formed with a plurality of arc-shaped recesses each located beside a respective one of the through holes of the main body.

8. The suspension lamp in accordance with claim 1, wherein the second conductive plate is substantially ring-shaped.

9. The suspension lamp in accordance with claim 1, wherein the wire connection base further includes a cap mounted on the main body.

10. The suspension lamp in accordance with claim 9, wherein the main body has a periphery formed with a plurality of through holes, the cap has a periphery formed with a plurality of through holes, and the wire connection base further includes a plurality of screws each extended through a respective one of the through holes of the cap and a respective one of the through holes of the main body, and a plurality of nuts each screwed on a respective one of the screws.

11. The suspension lamp in accordance with claim 9, further comprising a hollow threaded rod mounted in the switch box, and the cap has a center formed with a passage hole for passage of the threaded rod.

12. The suspension lamp in accordance with claim 11, wherein the main body has a center formed with the passage hole for passage of the threaded rod.

13. The suspension lamp in accordance with claim 1, further comprising a power supply wire having a positive pole formed with a first connecting terminal and a negative pole formed with a second connecting terminal, and the first connecting terminal and the second connecting terminal of the power supply wire are inserted into the first insertion slot and the second insertion slot of the main body respectively and are locked in the elastic locking members respectively.

14. The suspension lamp in accordance with claim 1, further comprising a plurality of electric wires each having a positive pole formed with a first connecting terminal and a negative pole formed with a second connecting terminal, and the first connecting terminal and the second connecting terminal of each of the electric wires are inserted into the first insertion slot and the second insertion slot of the main body respectively, and are locked in the elastic locking members respectively.

15. The suspension lamp in accordance with claim 1, wherein the first insertion slots and the second insertion slots of the main body are directed upward.

* * * * *